United States Patent [19]

Narita et al.

[11] Patent Number: 4,515,203

[45] Date of Patent: May 7, 1985

[54] CONTINUOUS STEEL CASTING PROCESS

[75] Inventors: Kiichi Narita, Kobe; Takasuke Mori, Ashiya; Kenzo Ayata, Kobe, all of Japan

[73] Assignee: Kabushiki Kaisha Kobe Seiko Sho, Kobe, Japan

[21] Appl. No.: 561,149

[22] Filed: Dec. 14, 1983

Related U.S. Application Data

[63] Continuation of Ser. No. 250,041, Apr. 1, 1981, abandoned.

[30] Foreign Application Priority Data

Apr. 2, 1980 [JP] Japan ..... 55-43339
Apr. 2, 1980 [JP] Japan ..... 55-43340
Apr. 2, 1980 [JP] Japan ..... 55-43341

[51] Int. Cl.[3] ..... B22D 27/02
[52] U.S. Cl. ..... 164/468; 164/504
[58] Field of Search ..... 164/468, 499, 504

[56] References Cited

U.S. PATENT DOCUMENTS 3,656,537 4/1972 Von Starck .
3,693,697 9/1972 Tzavaras .
3,804,147 4/1974 Babel et al. .
3,811,490 5/1974 Middleton et al. .
3,882,923 5/1975 Alberny et al. .
3,911,997 10/1975 Sugazawa et al. .
3,952,791 4/1976 Ito et al. .
3,981,345 9/1976 Alberny et al. .
3,995,678 12/1976 Zavaras et al. .
4,016,926 4/1977 Yamada et al. .
4,030,534 6/1977 Ito et al. .
4,042,007 8/1977 Zavaras et al. .
4,059,142 11/1977 Alberny et al. .
4,067,378 1/1978 Alberny et al. .
4,103,730 8/1978 Dussart .
4,106,546 8/1978 Sundberg .
4,139,048 2/1979 Andersson ..... 164/504
4,158,380 6/1979 Sasaki et al. .
4,178,979 12/1979 Birat et al. .
4,200,137 4/1980 Zavaras et al. .
4,243,092 1/1981 Hanas .
4,430,388 2/1984 Mola ..... 164/468

FOREIGN PATENT DOCUMENTS 16365 5/1978 Japan ..... 164/504
229759 11/1969 U.S.S.R. ..... 164/468

*Primary Examiner*—Kuang Y. Lin
*Attorney, Agent, or Firm*—Oblon, Fisher, Spivak, McClelland & Maier

[57] ABSTRACT

A continuous steel casting process adapted to produce steel castings of satisfactory quality with less center segregations is described. A molten steel is electromagnetically stirred in at least two of three locations, viz., a casting mold and intermediate and final solidifying zones of a continuously cast strand. In the casting mold, is applied a magnetic field induced by alternate current of a frequency $f=1.5\sim10$ Hz and having G in the range of $195\times e^{-0.18f}\sim1790\times e^{-0.2f}$ at the inner surface of the casting mold. The intermediate solidifying zone employs a magnetic field induced by alternate current of a frequency $f=1.5\sim10$ Hz and having a magnetic flux density G in the range of $195\times e^{-0.18f}\sim1790\times e^{-0.2f}$ at the surface of the strand or a magnetic field induced by alternate current of a frequency $f=50\sim60$ Hz and having a magnetic flux density G in the range of $0.6\times10^6/(D-107)^2\sim1.8\times10^6/(D-100)^2$ (in which D=the thickness of a solidified shell layer of the strand) at the surface of the strand. For electromagnetic stirring in the final solidifying zone, a magnetic field induced by alternate current of a frequency $f=1.5\sim10$ Hz and having a magnetic flux density in the range of $895\times e^{-0.2f}\sim2137\times e^{-0.2f}$ is applied.

15 Claims, 14 Drawing Figures

CONTINUOUS STEEL CASTING PROCESS

This application is a continuation of application Ser. No. 250,041, filed Apr. 1, 1981, now abandoned.

BACKGROUND OF THE INVENTION

1. Field of the Invention

This invention relates to a method for producing steel castings by continuous casting process.

2. Description of the Prior Art

In continuous steel casting, there arise problems of defects as detected by ultrasonic test, e.g., inclusions occurring in a sub-surface or internal portion of a continuously cast strand (hereinafter referred to as "c.c. strand" for brevity) in its solidifying stage or shrinkage cavities produced in axial center portions of the c.c. strand. In addition, strong segregation occurs in c.c. strands cast at high temperature in continuous casting operations, impairing cold forgeability due to lowered reduction ratio.

Various attempts have thus far been made to eliminate the internal defects of c.c. strands, including the center segregations and shrinkage cavities, through single electromagnetic stirring either within a mold or in a secondary cooling zone, severing tip ends of growing crystals with fluidic movements of molten steel to produce a large quantity of equiaxed crystal nuclei, thereby expanding the equiaxed crystal zone in the center portion of c.c. strands. However, none of them has succeeded in sufficiently reducing the rate of center segregation and irregularities of center segregation in the axial direction of c.c. strands, failing to produce steel castings of satisfactory quality.

SUMMARY OF THE INVENTION

It is a primary object of the present invention to provide a method which overcomes the above-mentioned problems and which is capable of producing steel castings of satisfactory quality with less center segregations in continuous steel casting processes.

In order to attain this object, the method of the present invention includes, in its preferred form, the step of electromagnetically stirring molten metal in at least two of three locations, viz., a casting mold and intermediate and final solidifying zones of a continuously cast strand, by application of:

for electromagnetic stirring in the casting mold, a magnetic field induced by alternate current of a frequency $f=1.5\sim10$ Hz and having G (Gauss) in the range of $195\times e^{-0.18f}\sim1790\times e^{-0.2f}$ at the inner surface of the casting mold;

for electromagnetic stirring in the intermediate solidifying zone, a magnetic field induced by alternate current of a frequency $f=1.5\sim10$ Hz and having a magnetic flux density G in the range of $195\times e^{-0.18f}\sim1790\times e^{0.2f}$ at the surface of the strand or a magnetic field induced by alternate current of a frequency $f=50\sim60$ Hz and having a magnetic flux density G in the range of $0.6\times10^6/(D-107)^2\sim1.8\times10^6/(D-100)^2$ (in which D= the thickness of a solidified shell layer of the strand (mm)) at the surface of the strand; and for electromagnetic stirring in the final solidifying zone, a magnetic field induced by alternate current of a frequency $f=1.5\sim10$ Hz and having a magnetic flux density in the range of $895\times e^{-0.2f}\sim2137\times e^{-0.2f}$ at the surface of the strand.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF PREFERRED EMBODIMENTS

The electromagnetic stirring which provokes motive forces in molten steel in a continuous steel casting process, if too weak, fails to reduce in a sufficient degree the aforementioned inclusions in molten steel and the negative and center segregations. On the other hand, excessively intense stirring will contrarily act to increase abruptly the amounts of inclusions and the negative segregations in c.c. strands. Therefore, in consideration of the inclusion levels as well as the ratios of negative and center segregations, extensive experiments and studies of various factors in electromagnetic stirring were carried out for producing steel materials of satisfactory quality by the continuous casting process, thus attaining the present invention.

The method of the present invention is now illustrated by way of an example which applies the invention to a low carbon killed steel. Molten steel was prepared by the use of an LD converter, which substantially had, after adjustments of Al and FeMn components at the time of tapping, a chemical composition of C=0.13%, Mn=0.45%, Si=0.06%, P=0.014%, S=0.017%, Cu=0.01%, Ni=0.01%, Cr=0.02%, Mo=0.01% and Al=0.035%. After refining treatment, the molten steel was continuously fed into a casting mold through a submerged nozzle, establishing a non-oxidizing state by Ar-seal from the ladle to the tundish and mold to prevent production of inclusions at the time of casting while continuously supplying the molten steel to the mold through the submerged nozzle.

The molten steel in the casting mold is added to lubricant type powder, for example, powder of $SiO_2=33.9\%$, $CaO=34.0\%$, $Al_2O_3=4.3\%$, $Fe_2O_3=2.0\%$, $Na_2O=8.4\%$, $K_2O=0.6\%$, $MgO=0.9\%$, $F=5.1\%$, and $C=5.5\%$. The molten steel in the casing mold, by the cooling effect of mold wall surfaces, begins to solidify from its outer peripheral surface and is continuously drawn out downward of the mold for transfer to a secondary cooling zone. An electromagnetic coil is provided around the outer periphery of the casting mold, which is imparted with alternate current to induce a magnetic field for electromagnetic stirring.

According to the method of the present invention, for the electromagnetic stirring within the casting mold, a frequency of 1.5–10 Hz which is smaller in attenuation is used so that the magnetic force will reach the molten steel through the copper walls of the mold of low magnetic permeability. In order to have suitable electromagnetic stirring within the mold, the magnetic flux density at the inner wall surface of the mold, which is induced by the electromagnetic coil, is an important factor in addition to the frequency.

Figure 1:
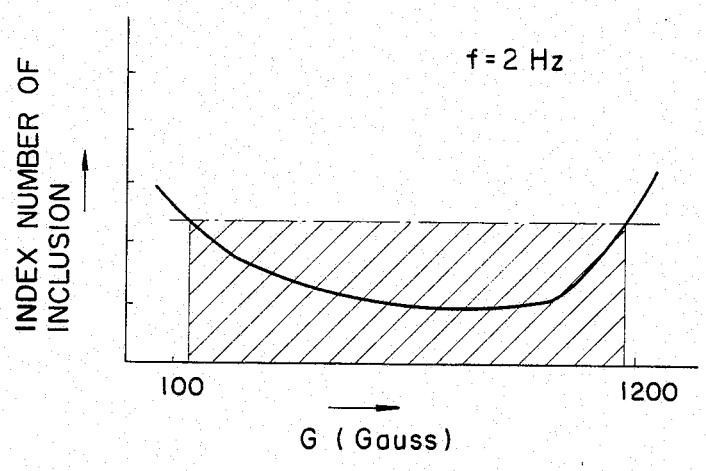
FIG. 1 is a diagram of magnetic flux density vs. index number of inclusions.

FIG. 1 is a diagram of the index number of inclusions in c.c. strands occurring when the magnetic flux density which represents the intensity of stirring is varied in a number of ways at each frequency of applied current. It is seen therefrom that the magnetic flux density should be restricted to a certain range in view of the allowable limit of the index number of inclusions in practically acceptable c.c. strands. Namely, in order to provoke predetermined movements in the molten steel by stirring, the values dictated by the frequency and magnetic flux density is required to fall within predetermined ranges. In the diagram of FIG. 1, the value of frequency f should be in the range of 1.5~10.0 Hz while the value of magnetic flux density G in the range of $$195\times e^{-0.18f} << G << 1790\times e^{-0.2f}$$

In other words, outside those ranges the c.c. strands contain inclusions in increased amounts which reflect low cold forgeability, so that cracks are easily produced, thus increasing the proportion of defective products.

The electromagnetic stirring in the above-mentioned ranges urges production of equiaxed crystal nuclei in the molten steel. More particularly, the production of equiaxed crystal nuclei by the stirred molten steel takes place more easily in the initial stage of solidification where the columnar dendrites growing from the outer surface of c.c. strand are still very fine and readily severed, permitting fine equiaxed crystal nuclei to be produced in a large quantity. Further, the production of equiaxed crystal nuclei is accelerated by the chilling effect resulting from molten steel flows in the meniscus portions of the mold.

Figure 2:
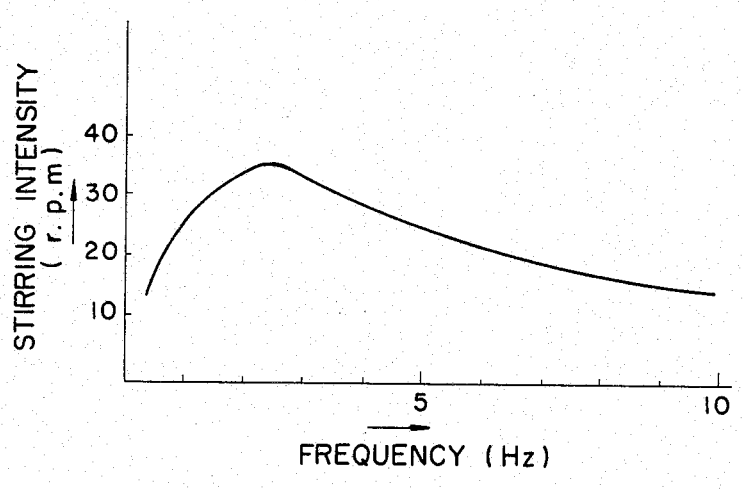
FIG. 2 is a diagram of frequency vs. stirring intensity in c.c. strands of large sectional areas.

With regard to the frequency of current to be applied to a production of a c.c. strand of a sectional area larger than 400 $cm^2$, it is recommended to set the frequency preferably in the range of 1.5~4 Hz in view of the strong magnetic permeability which is required to achieve a suitable intensity of electromagnetic stirring. In this connection, FIG. 2 illustrates the intensities of the electromagnetic stirring actions at different frequencies occurring in c.c. strands of large sectional areas. It is seen therefrom that a suitable intensity of electromagentic stirring can be obtained by setting the frequency in the range of 1.5~4 Hz. Of course, the magentic flux density in such cases is restricted to the range governed by the abovementioned formula.

The c.c. strand which is drawn out through the lower end of the mold after the electromagnetic stirring in the mold is again subjected to electromagnetic stirring in the intermediate solidifying zone of the c.c. strand upon passage through a magnetic field induced by an electromagnetic coil which is located around the c.c. strand for further stirring unsolidified molten steel in the strand. In this instance, the electromagnetic stirring is required to employ a low frequency (1.5~10 Hz) in view of the magnetic permeability and a magnetic flux density G (gauss) in the range of $195\times e^{-0.18f} << G << 1790\times e^{-0.2f}$ at the surface of the c.c. strand. In a case where the electromagnetic coil can approach the c.c. strand, a commercial frequency of 50~60 Hz may be used instead of low frequency. In such a case, the range of appropriate magnetic flux density G (gauss) for a c.c. strand with a solidified shell thickness of Dmm is $$\frac{0.6\times 10^6}{(D-107)^2} \leqq G \leqq \frac{1.8\times 10^6}{(D-100)^2}.$$

Figure 3:
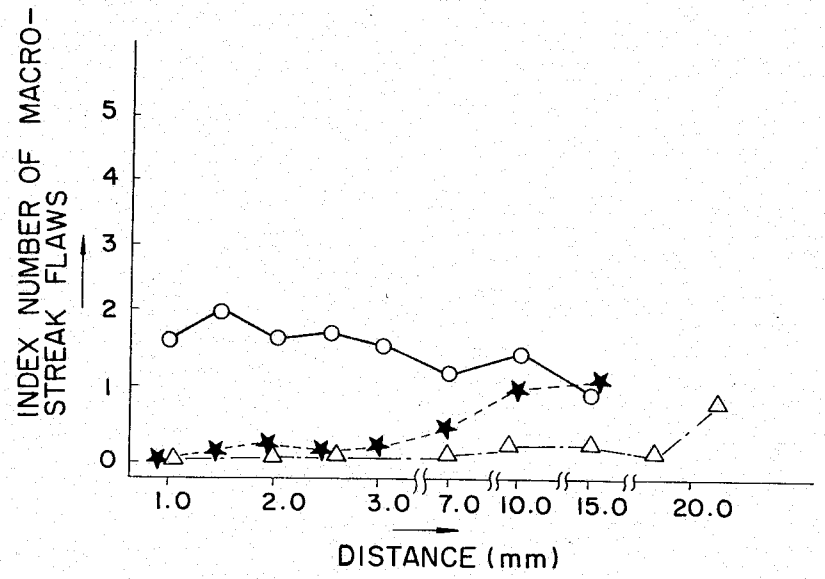
FIG. 3 is a diagram showing numbers of macrostreak flaws on c.c. strands produced with no stirring and of c.c. strands with stirring within mold alone and stirring in both mold and intermediate solidifying zone.

By effecting the electromagnetic stirring in the intermediate solidifying zone of a c.c. strand in addition to that within the casting mold, the inclusions are reduced in a broader area across the width of the c.c. strand, improving its cold forgeability all the more. Further, the electromagnetic stirring in the intermediate solidifying zone contributes to the production of equiaxed crystal nuclei in that area. FIG. 3 illustrates the numbers of macrostreak flaws (in index numbers) in c.c. strands with no electromagnetic stirring (symbol "o"), single stirring in the mold (symbol "*") and dual stirring in the mold and intermediate solidifying zone according to the present invention (symbol "Δ") in relation with the distance from the surface layer to the center axis of each strand. It is observed therefrom that the number of macrostreak flaws is suppressed inwardly from the surface layer in the strand obtained by the method of the present invention.

In the production of a low carbon steel by the continuous casting process, there arises a problem of shrinkage cavities occurring in the center portions of c.c. strands, which is a problem inherent in low carbon steels, in addition to the above-mentioned problem of inclusions. This problem can be eliminated by an electromagnetic stirring treatment in a final solidifying zone of the c.c. strand further to the stirring treatment in the mold and/or in the intermediate solidifying zone.

The term "final solidifying zone" of molten steel as used herein refers to that stage where, as a result of progress of solidification into equiaxed crystals, the shorter diameter of the molten steel pool has become smaller than 100 mm in the case of c.c. strands greater than 200 mm□ or become smaller than ½ the length of the shorter side of the strand in the case of c.c. strands smaller than 200 mm□.

Figure 4A:
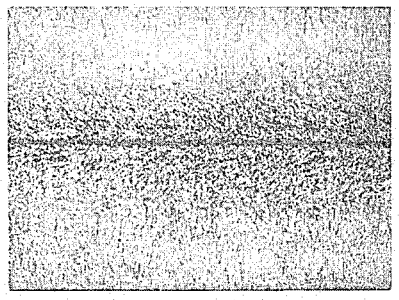
FIGS. 4A and 4B are photos of macrostructures of c.c. strands in section.
Figure 4B:
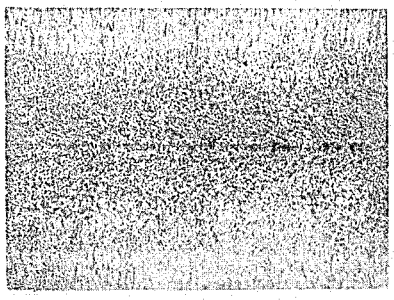

The so-called "bridging" phenomenon occurs in the low carbon steel due to rapid growth of columnar crystals. However, the above-described electromagnetic stirring in the mold and/or in the intermediate solidifying zone has the effect of severing the columnar crystals, increasing the amount of equiaxed crystals. The electromagnetic stirring of the pool of molten steel in the final solidifying stage serves to disperse the molten steel between the individual equiaxed crystal grains and thus to reduce the temperature gradient. Then, the entire unsolidified portions are solidified almost simultaneously, so that the shrinkage cavities are dispersed to suppress production of consecutive cavities in the center portion. Appropriate conditions for the electromagnetic stirring in the final solidifying zone essentially include a frequency in the range of 1.5~10 Hz and a magnetic flux density G(gauss) at the surface of the c.c. strand in the range of $895\times e^{-0.2f}<<G<<2137\times e^{-0.2f}$. FIG. 4 shows photos of macrostructures in section of c.c. strands (A) and (B) by single electromagnetic stirring in the mold and by dual or combined electromagnetic stirring in the mold and final solidifying zone, respectively. As clear therefrom, shrinkage cavities in the center portion is conspicuously suppressed in the c.c. strand (B) according to the method of the present invention.

As clear from the foregoing description, synergistic effects are produced in the method of the present invention which subjects the c.c. strand to electromagnetic stirring at least at two positions along its passage through the casing mold, intermediate solidifying zone and final solidifying zone under particular frequency and magnetic flux density conditions. Although the foregoing description deals with a low carbon steel, the present invention is also applicable to medium and high carbon steels.

In an application to a medium or high carbon steel, where reductions of negative and center segregations are desired, it is recommended to set the frequency, for the electromagnetic stirring in the mold, in the range of 1.5~10 Hz and the magnetic flux density G(gauss) at the surface of the c.c. strand in the range of $$268\times e^{-0.18f}\leqq G\leqq 745\times e^{-0.2f} \quad (1)$$

and, for the electromagnetic stirring in the intermediate solidifying zone of the c.c. strand, to set the frequency in the range of 1.5~10 Hz and the magnetic flux density at the surface of the c.c. strand in the range of $$268\times e^{-0.18f}\leqq G\leqq 745\times e^{0.2f} \quad (2)$$

or to use commercial frequency of 50~60 Hz to produce a magnetic flux density at the surface of the c.c. strand in the range of $$750{,}000/(D-107)^2\leqq G\leqq 750{,}000/(D-100)^2 \quad (3)$$

Figure 5:
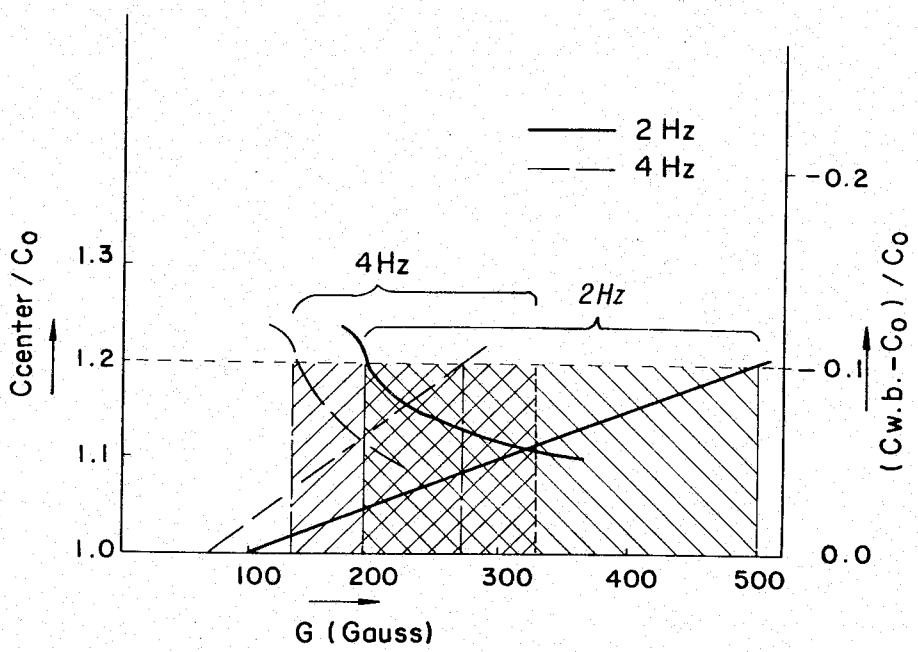
FIG. 5 is a diagram of magnetic flux density vs. center segregation ratio vs. negative segregation ratio in white band.

The following embodiment explains the above-defined ranges from the standpoint of center segregation. FIG. 5 is a diagram of the ratio of center segregation vs. ratio of segregation in surface layer produced under different intensities of electromagnetic stirring, namely, by varying the magnetic flux density at each frequency of applied alternate current in electromagnetic stirring in the mold, using molten steel which was obtained by 3-charge blowing in an LD converter and which, after adjustments of Al and Fe components at the time of tapping, had a chemical composition of C=0.61%, Mn=0.90%, Si=1.65%, P=0.020%, S=0.015%, Cu=0.13%, Ni=0.01%, Cr=0.02%, Mo=0.01% and Al=0.030%. It is seen therefrom that the magnetic flux density should be restricted to a certain range in view of the allowable ranges of the ratio of center segregation and the ratio of negative segregation in the surface layer for this sort of c.c. strands. Namely, in order to impart predetermined stir in the molten steel, it is necessary for the magnetic flux density to fall in a certain range dictated by the frequency. As seen in the diagram of FIG. 5, the appropriate frequency f of the alternate current is in the range of 1.5~10 Hz and the appropriate magnetic flux density G (gauss) at the surface of the c.c. strand is in the range of $$268\times e^{-0.18f}\leqq G\leqq 745\times e^{-0.20f} \quad (1)$$

Values in excess of the above-mentioned range result in c.c. strands which are inferior in cold forgeability due to increases of center segregations and which have low quench hardness due to increases of negative segregations in the surface layer, which will be reflected by a practically unacceptable high proportion of defective products.

Figure 6:
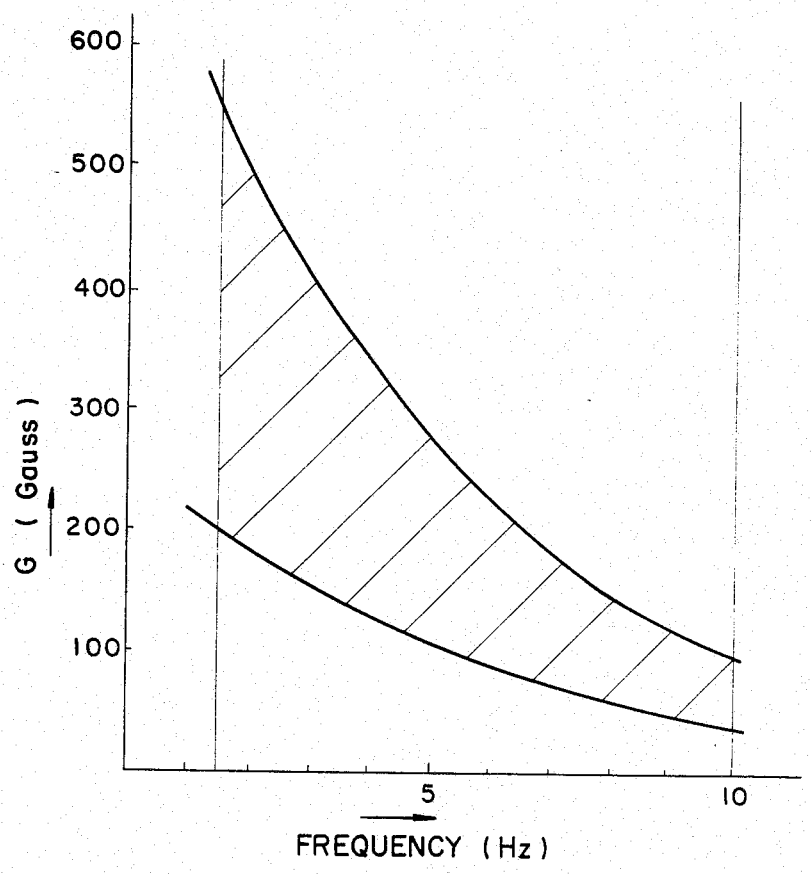
FIG. 6 is a diagram of an optimum range of magnetic flux density.

More particularly, FIG. 5 shows the effects of in-mold low-frequency stirring (1.5~10 Hz) on center segregation of carbon and negative segregation in white band in continuous casting of 0.60%C blooms, in which the ratio of center segregations on the left ordinate drops sharply with increases in a particular range of the magnetic flux density on the abscissa. On the other hand, the negative segregation in white band, plotted on the right ordinate, linearly increases with the magnetic flux density. FIG. 5 indicates by hatching an optimum zone of electromagnetic stirring where the center segregation ratio of C is less than 1.2 and the negative segregation ratio of C is less than −0.10. The optimum range of magnetic flux density becomes narrower and lower at a higher frequency, it being 187–500 at 2 Hz and 130–335 at 4 Hz. The hatched area in FIG. 6 indicates the optimum range in the relations between the frequency and magnetic flux density, which is expressed by Formula (1) given hereinbefore.

Figure 7:
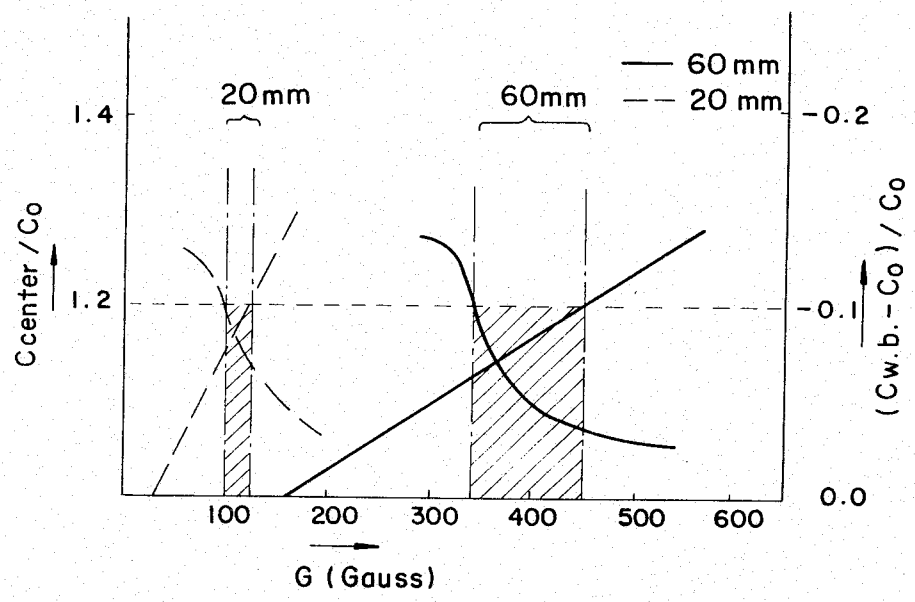
FIG. 7 is a diagram similar to FIG. 5.
Figure 8:
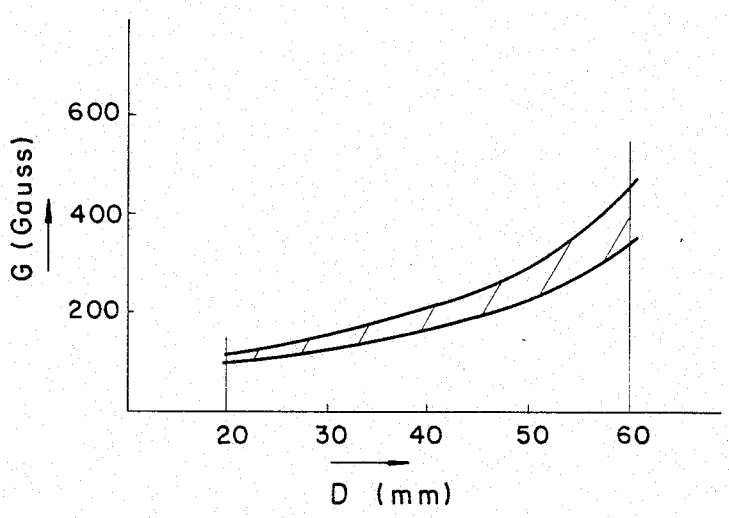
FIG. 8 is a diagram of an optimum range of magnetic flux density similar to FIG. 6.

For further reduction of irregularities in the center segregation in the axial direction of c.c. strands after the in-mold electromagnetic stirring, it is effective to subject the strands once again to electromagnetic stirring of predetermined conditions in the intermediate solidifying zone, which improves the center segregation by producing a greater amount of equiaxed crystals. The electromagnetic stirring in the intermediate solidifying zone should be carried out at the above-defined frequency and in the magnetic flux density range ((2) or (3)) mentioned hereinbefore. The optimum range (2) is determined by the same reasons as considered for the in-mold stirring. However, the shell thickness in the intermediate solidifying zone has to be considered in a case where commercial frequency is used. Similarly to FIG. 5, FIG. 7 illustrates the magnetic flux density of the electromagnetic stirring in the intermediate solidifying zone in relation with center segregations and negative segregations in the white band with regard to c.c. strands with shell thicknesses of 20 mm and 60 mm, indicating the respective optimum ranges by hatching. The optimum range of the magnetic flux density is shown in relation with the solidified shell thickness (Dmm) in FIG. 8.

Figure 9:
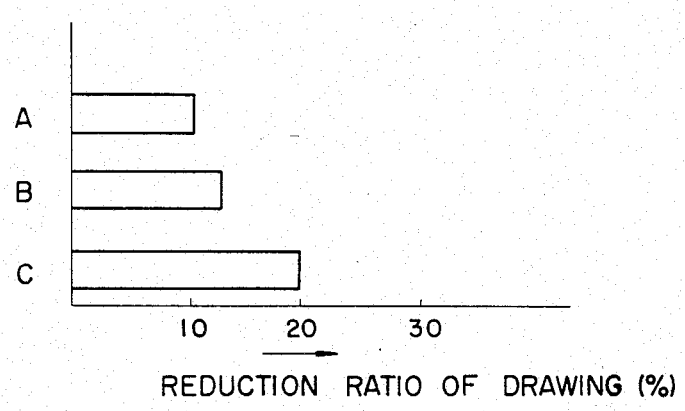
FIG. 9 is a diagram of drawing reduction ratio.

As mentioned hereinbefore, the application of the electromagnetic stirring subsequent to the in-mold stirring has the effect of reducing segregations in c.c. strands. This effect is illustrated in terms of reduction ratio of drawing in FIG. 9, from which it will be seen that the drawing reduction rate of a sample (C) according to the invention is improved distinctively as compared with a sample (A) with no stirring and a sample (B) with in-mold stirring alone.

Although the irregularities of center segregations in the axial direction of c.c. strands can be improved by the combined electromagnetic stirring in the mold and the intermediate solidifying zone, the rate of center segregation (mean concentration in axial center portion) can be improved further by producing an electromagnetic stir in the final solidifying zone in addition to the stirring in the mold and/or in the intermediate solidifying zone. Upon provoking a flow in the pool of molten steel by electromagnetic stirring in the final solidifying zone, the molten steel is stirred within the equiaxed crystal zone of molten steel. The stirring in the final solidifying zone where the residual molten steel has almost no temperature gradient as compared with the stirring of the columnar crystal zone causes the molten steel undergoing densification at the interface of solidification to be distributed between the individual crystal grains while preventing further forward or backward movement of the molten steel. Therefore, the solidification proceeds almost simultaneously in the molten steel pool, occluding densified molten steel between the individual crystal grains, thereby broadening the white band to reduce the possibility of segregation. In this connection, the magnetic flux density should also be limited to a certain range in consideration of the allowable ranges of the rate of center segregation and the rate of negative segregation in the white band of practically acceptable c.c. strands of this sort. Namely, in order to provoke a predetermined stir in the molten steel, the magnetic flux density of the electromagnetic stirring should be in a certain range relative to the frequency. As seen in the diagram of FIG. 10, the optimum range of the magnetic flux density G (gauss) at the surface of a c.c. strand for alternate current of a frequency of 1.5~10 Hz is $$895\times e^{-0.20f} \leqq G \leqq 2137\times e^{-0.20f} \quad (4)$$

In other words, a magnetic flux density in excess of that range will result in c.c. strands which are inferior in cold forgeability due to a large amount of center segregation or which have low quench hardness owing to increased negative segregation in the white band, increasing the proportion of practically unacceptable, defective products.

Figure 10:
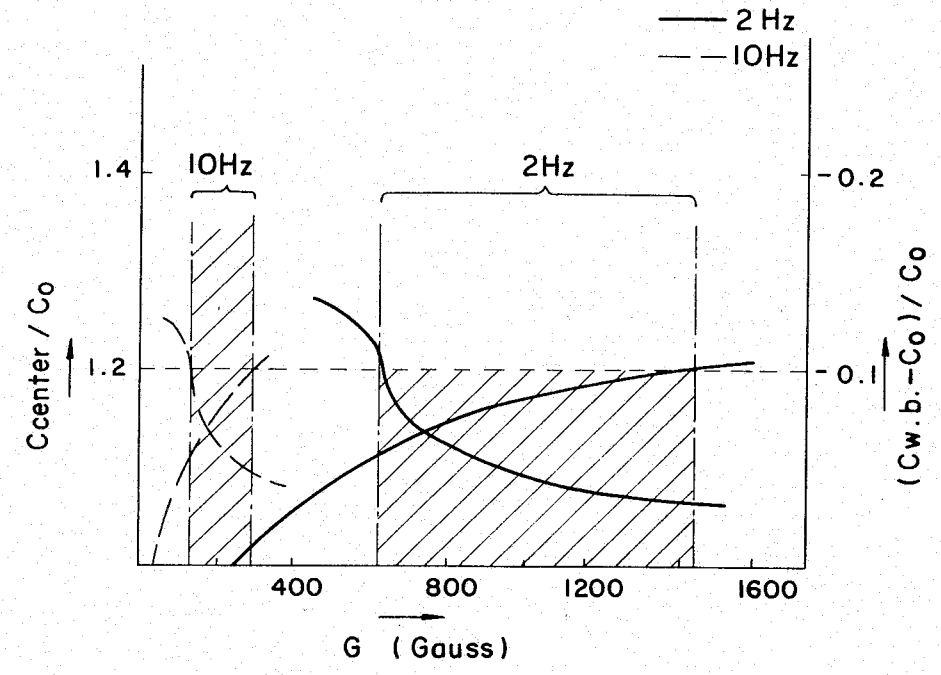
FIG. 10 is a diagram similar to FIGS. 5 and 7.
Figure 11:
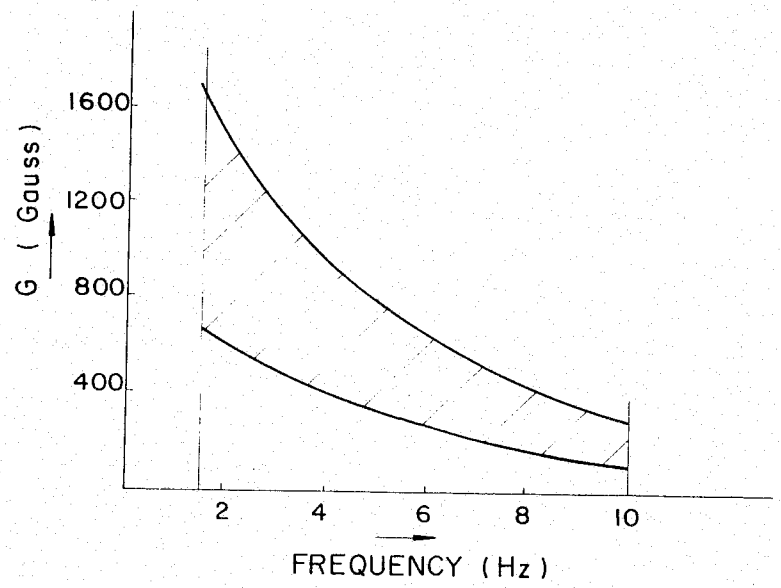
FIG. 11 is a diagram showing optimum range of magnetic flux density.

More particularly, similarly to FIGS. 5 and 7, FIG. 10 illustrates the effects of circumferentially applied low-frequency power (1.5~10 Hz) stirring on the center segregation and negative segregation in the white band in continuous casting of 0.60%C steel blooms. From these relations, the optimum range of the magnetic flux density was obtained as shown in FIG. 11, which is defined by Formula (4).

Figure 12:
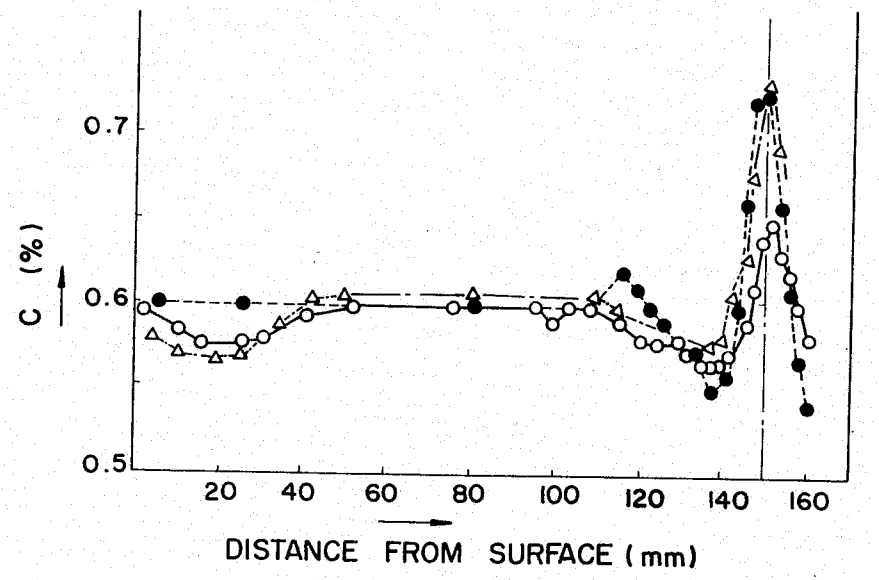
FIG. 12 is a diagram of segregations in widthwise direction of c.c. strand.

FIG. 12 plots mean values of carbon contents in the draw direction across the width of a c.c. strand of 0.60%C steel obtained after electromagnetic stirring in the mold and in the final solidifying zone under the above-described conditions. It is clear therefrom that the electromagnetic stirring of molten steel in the mold (M) final solidifying zone (F) (o) reduces the formation of the negative segregation generally referred to as white band and considerably minimize the center segregation in contrast to no stirring (●) and stirring in the mold alone (Δ). The combination of the in-mold electromagnetic stirring and the electromagnetic stirring in the final solidifying zone of the c.c. strand produces synergistic effects, thereby not only suppressing irregularities of center segregations in the axial direction of c.c. strand but also lowering the rate of center segregation, to improve various properties of the resulting c.c. strands, including the cold forgeability. Needless to say, further improved results can be obtained by subject c.c. strands in each of the casting mold, intermediate solidifying zone and final solidifying zone.

Figure 13:
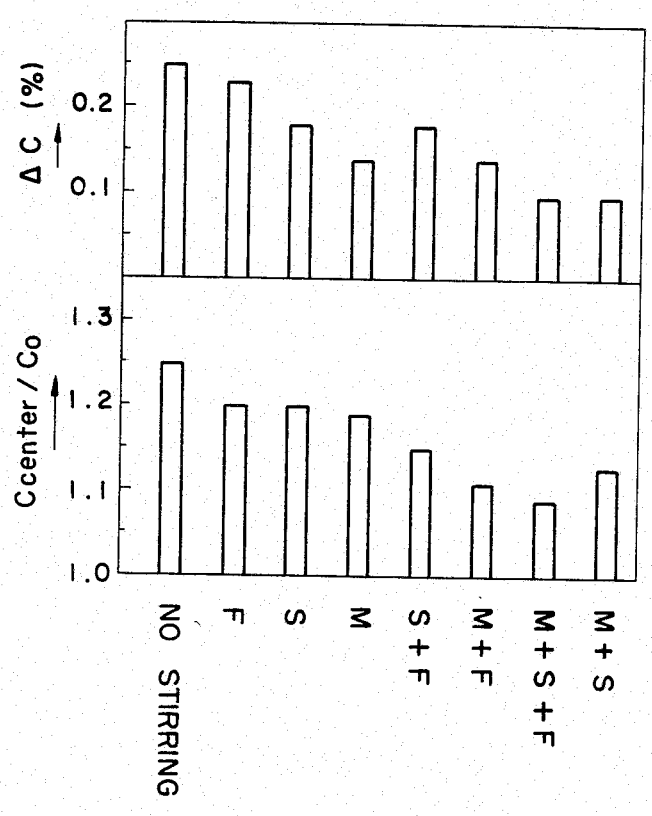
FIG. 13 is a diagram of segregations under different stirring conditions.

FIG. 13 shows the ratio of center segregation and maximum values in irregularities of center segregation in the axial direction of c.c. strands against a white band negative segregation ratio of −0.10 in continuous casting of (200–300)×400 blooms of 0.60%C steel with regard to a situation employing no electromagnetic stirring, a situation effecting single electromagnetic stirring in the mold (M), intermediate solidifying zone (S) or final solidifying zone (F) alone, and a case effecting combined electromagnetic stirring at least at two positions in the mold and intermedial and final solidifying zones of c.c. strands according to the method of the present invention. It is observed therefrom that the combined electromagnetic stirring at least at two of the three positions, i.e. a position in the casting mold, a position in the intermediate solidifying zone and a position in the final solidifying zone, manifests synergistic effect in improving the ratio of center segregation and irregularities in center segregation as compared with non-stirring and single stirring at one position.

The continuously cast strands produced with the combined electromagnetic stirring at all of the positions in the casing mold, intermediate solidifying zone and final solidifying zone, c.c. strands produced with the combined electromagnetic stirring in the casting mold and intermediate solidifying zone, and c.c. strands produced with the combined electromagnetic stirring in the casing mold and final solidifying zone are excellent in that order with regard to the ratio of center segregation as well as irregularity of center segregation.

As clear from the foregoing description, the method of the present invention effectively reduces inclusions of both high and medium carbon steels, effectively suppressing the ratio of and irregularities center segregation by the combinined electromagnetic stirring especially in a case where the center segregation is problematic, thereby ensuring production of c.c. strands of satisfactory quality.

Thus, the method of the present invention permits the production of c.c. strands which are improved as to segregation, inclusions, surface quality, cold forgeability, machinability and quench hardness, by the continuous casting process relatively at a low cost.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of producing continuously cast steel strands which have outer surfaces and which are greater than 200 mm×200 mm in cross-section by a continuous casting process in which molten steel is fed into a casting mold having an inner wall surface through a submerged nozzle and continuously drawn out downwardly of the casting mold, said method comprising the steps of:

(a) electromagnetically stirring the molten steel at a position within said casting mold by application of a magnetic field induced by an alternating current of a frequency f=1.5 to 10 Hz and having a magnetic flux density G at the inner wall surface of said casting mold in the range of $195\times e^{-0.18f}$ to $1,790\times e^{-0.2f}$ gauss and also (b) electromagnetically stirring the molten steel at a position in the final solidifying zone of each of said continuously cast strands by application of a magnetic field induced by an alternating current of a frequency f=1.5 to 10 Hz and having a magnetic flux density G at the outer surface of each of said continuously cast strands in the range of $895\times e^{-0.2f}$ to $2,137\times e^{-0.2f}$ gauss, said final solidifying zone being defined as the zone where the molten steel in each of said continuously cast strands is present as a molten steel pool having a generally circular or ovular cross-sectional shape and where the shorter diameter of the molten steel pool is less than 100 mm in length.

2. A method as recited in claim 1 and further comprising the step of electromagnetically stirring the molten steel at a position in the intermediate solidifying zone of each of said continuously cast strands by application of a magnetic field induced by an alternating current of a frequency f=1.5 to 10 Hz and having a magnetic flux density G at the outer surface of each of said continuously cast strands in the range of $195\times e^{-0.18f}$ to $1,790\times e^{-0.2f}$ gauss, said intermediate solidifying zone being the zone between said casting mold and said final solidifying zone.

3. A method as recited in claim 1 and further comprising the step of electromagnetically stirring the molten steel at a position in the intermediate solidifying zone of each of said continuously cast strands by application of a magnetic field induced by an alternating current of a frequency f=50 to 60 Hz and having a magnetic flux density G at the outer surface of each of said continuously cast strands in the range of $0.6\times 10^6/(D-107)^2$ to $1.8\times 10^6/(D-100)^2$ gauss, where D=the solidified shell thickness in millimeters of each of said continuously cast strands, said intermediate solidifying zone being the zone between said casting mold and said final solidifying zone.

4. A method as recited in claim 1 wherein the magnetic flux density G at the inner wall surface of said casting mold is in the range of $268\times e^{-0.18f}$ to $745\times e^{-0.2f}$ gauss.

5. A method as recited in claim 2 or 4 wherein the magnetic flux density G at the outer surface of each of said continuously cast strands in said intermediate solidifying zone is in the range of $268\times e^{-0.18f}$ to $745\times e^{-0.2f}$ gauss.

6. A method as recited in claim 3 wherein the magnetic flux density G at the outer surface of each of said continuously cast strands in said intermediate solidifying zone is in the range of $0.75\times 10^6/(D-107)^2$ to $0.75\times 10^6/(D-100)^2$ gauss.

7. A method as recited in claim 1 wherein the molten steel in said casting mold is elecromagnetically stirred by a magnetic field induced by an alternating current of a frequency f=1.5 to 4 Hz.

8. A method as recited in claim 4 wherein the magnetic flux density G at the outer surface of each of said continuously cast strands in said intermediate solidifying zone is in the range of $0.75\times 10^6/(D-107)^2$ to $0.75\times 10^6/(D-100)^2$ gauss.

9. A method of producing continuously cast steel strands which have outer surfaces and which are less than 200 mm×200 mm in cross-section by a continuous casting process in which molten steel is fed into a casting mold having an inner wall surface through a submerged nozzle and continuously drawn out downwardly of the casting mold, said method comprising the steps of:

(a) electromagnetically stirring the molten steel at a position within said casting mold by application of a magnetic field induced by an alternating current of a frequency f=1.5 to 10 Hz and having a magnetic flux density G at the inner wall surface of said casting mold in the range of $195\times e^{-0.18f}$ to $1,790\times e^{-0.2f}$ gauss and also (b) electromagnetically stirring the molten steel at a position in the final solidifying zone of each of said continuously cast strands by application of a magnetic field induced by an alternating current of a frequency f=1.5 to 10 Hz and having a magnetic flux density G at the outer surface of each of said continuously cast strands in the range of $895\times e^{-0.2f}$ to $2,137\times e^{-0.2f}$ gauss, said final solidifying zone being defined as the zone where the molten steel in each of said continuously cast strands is present as a molten steel pool having a generally circular or ovular cross-sectional shape and where the shorter diameter of the molten steel pool is less than one-half the length of the shorter side of said continuously cast strand.

10. A method as recited in claim 9 and further comprising the step of electromagnetically stirring the molten steel at a position in the intermediate solidifying zone of each of said continuously cast strands by application of a magnetic field induced by an alternating current of a frequency f=1.5 to 10 Hz and having a magnetic flux density G at the outer surface of each of said continuously cast strands in the range of $195\times e^{-0.18f}$ to $1,790\times e^{-0.2f}$ gauss, said intermediate solidifying zone being the zone between said casting mold and said final solidifying zone.

11. A method as recited in claim 9 and further comprising the step of electromagnetically stirring the molten steel at a position in the intermediate solidifying zone of each of said continuously cast strands by application of a magnetic field induced by an alternating current of a frequency f=50 to 60 Hz and having a magnetic flux density G at the outer surface of each of said continuously cast strands in the range of $0.6\times 10^6/(D-107)^2$ to $1.8\times 10^6/(D-100)^2$ gauss, where D=the solidified shell thickness in millimeters of said continuously cast strands, said intermediate solidifying zone being the zone between said casting mold and said final solidifying zone.

12. A method as recited in claim 9 wherein the magnetic flux density G at the inner wall surface of said casting mold is in the range of $268\times e^{-0.18f}$ to $745\times e^{-0.2f}$ gauss.

13. The method as recited in claim 10 or 12 wherein the magnetic flux density G at the outer surface of each of said continuously cast strands in said intermediate solidifying zone is in the range of $268\times e^{-0.18f}$ to $745\times e^{-0.2f}$ gauss.

14. A method as recited in claim 11 wherein the magnetic flux density G at the outer surface of each of said continuously cast strands in said intermediate solidifying zone is in the range of $0.75\times 10^6/(D-107)^2$ to $0.75\times 10^6/(D-100)^2$ gauss.

15. A method as recited in claim 12 wherein the magnetic flux density G at the outer surface of each of said continuously cast strands in said intermediate solidifying zone is in the range of $0.75\times 10^6/(D-107)^2$ to $0.75\times 10^6/(D-100)^2$ gauss.

* * * * *